United States Patent [19]

Read

[11] Patent Number: 4,649,995

[45] Date of Patent: Mar. 17, 1987

[54] WELL TREATING APPARATUS

[75] Inventor:- Norman W. Read, Dallas, Tex.

[73] Assignee: Dresser Industries, Inc., Dallas, Tex.

[21] Appl. No.: 777,465

[22] Filed: Sep. 17, 1985

[51] Int. Cl.[4] ..... E21B 33/12

[52] U.S. Cl. ..... 166/115; 166/181; 166/242

[58] Field of Search ..... 166/115, 116, 181, 182, 166/184, 242, 387

[56] References Cited

U.S. PATENT DOCUMENTS

| | | | |
|---|---|---|---|
| 3,470,952 | 10/1969 | Blount | 166/242 |
| 3,978,923 | 9/1976 | Ford | 166/242 |
| 4,523,643 | 6/1985 | McGlothen | 166/175 |
| 4,573,529 | 3/1986 | Reinhardt | 166/115 |

*Primary Examiner*—Stephen J. Novosad
*Assistant Examiner*—William P. Neuder

[57] ABSTRACT

Apparatus for treating an isolated zone of a well bore includes primary and secondary tubing strings extending from the surface of the well releasably connected to a packer that has been set therein. The primary tubing string extends through the packer whereby the well can be produced or chemical can be injected to treat the isolated zone. The secondary string is of substantially smaller size and is arranged so that it is isolated from the primary tubing string which extends through the releasable connection and through the packer whereby inhibitors, diluents, and the like can be injected in the zone to be treated.

6 Claims, 7 Drawing Figures

WELL TREATING APPARATUS

BACKGROUND OF THE INVENTION

This invention relates generally to well treating apparatus. More particularly, but not by way of limitation, this invention relates to apparatus for delivering liquids, such as inhibitors, diluents and the like, to a selected zone in a well bore that may have been chemically treated.

In chemically treating zones of well bores, one method involves extending a well packer into the bore on a tubing string that extends from the surface of the well bore. The chemical, such as acid, is pumped down the tubing string and through the packer wherein the chemical is directed into contact with the selected zone. Many times, it is desirable to neutralize, inhibit, or dilute the chemicals with which the formation has been treated. Such materials are generally pumped down the tubing through which the treating chemical was delivered to the formation and thus a substantial volume of the materials will necessarily be utilized even though only a relatively small amount of such chemical is actually needed. Such a process results in unnecessary use of chemicals, which are relatively expensive, and excessive time for performing the process, which is also expensive.

Accordingly, an object of this invention is to provide improved apparatus for delivering liquids, such as inhibitors, diluents and the like, to a selected zone of a well bore that has been chemically treated and that obviates the disadvantages set forth above.

SUMMARY OF THE INVENTION

This invention provides apparatus for delivering liquids, such as inhibitors, diluents and the like, to a selected zone of a well bore that has been chemically treated, the apparatus includes: conduits extending from the surface into the well bore, the conduits providing first and second flow passageways; a packer located in the well bore isolating the treated zone and having a central flow passageway and an annular flow passageway therethrough; and, a releasable device connecting the packer and conduits with the first flow passageway and central flow passageway being connected and with the second flow passageway and annular flow passageway being connected whereby treating fluids can be injected through the first and central flow passageways and inhibitors, diluents and the like can be delivered through the second and annular flow passageways to the treated zone of the well bore.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF THE PREFERRED EMBODIMENT

Figure 1A:
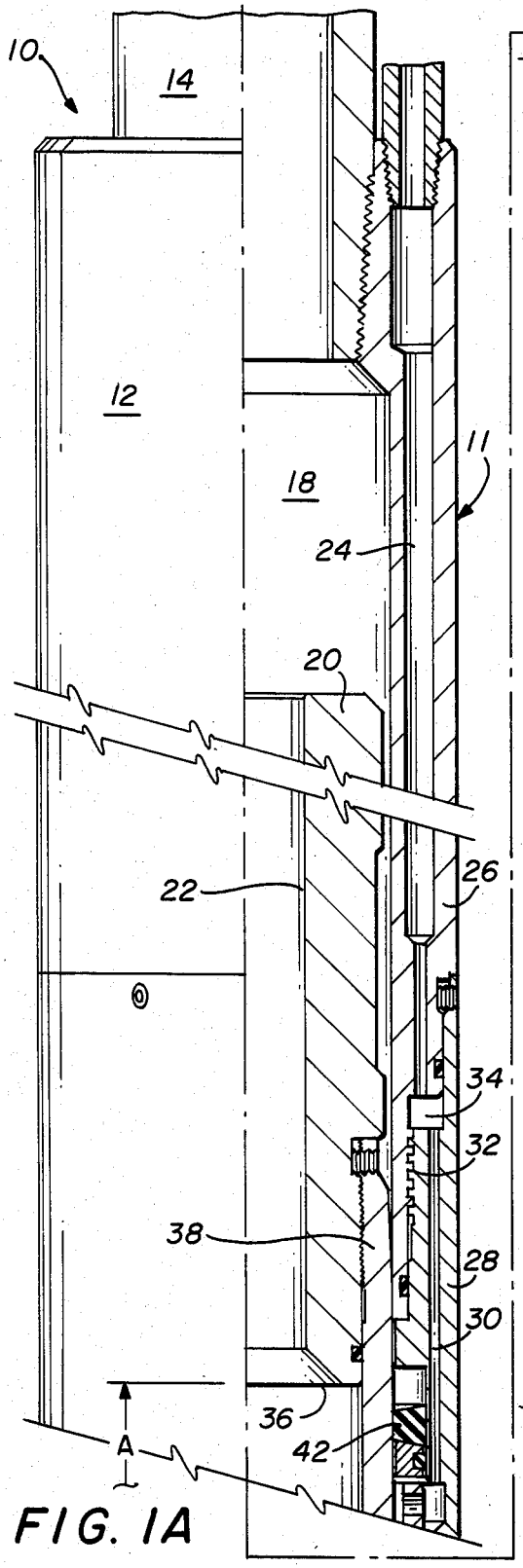
FIGS. 1A through 1E taken together illustrate treating apparatus that is constructed in accordance with the invention.

Referring to the drawing and to FIGS. 1A through 1E, shown therein and generally designated by the reference character 10, is a well treating apparatus that is constructed in accordance with the invention. The apparatus 10 includes an upper connection means 11 that is arranged at its upper end to be threadedly connected to a tubing string 14 that extends to the surface of the well. The upper connection means 11 is also threadedly connected to a secondary tubing string 16 that is of much smaller diameter than the tubing string 14. The secondary tubing string 16 also extends to the surface of the well.

The connection means 11 includes a connection sleeve 12 a central bore 18 that is sized to receive a tubular having stop member 20 which is provided for purposes that will become apparent hereinafter. The stop member 20 has a central bore 22 that extends therethrough in fluid communication with the bore 18. The secondary tubing string 16 is connected to the sleeve 12 and is in fluid communication with a passageway 24 that extends through a lower end 26 of the sleeve 12.

An adapter sleeve 28 includes a bore 30 that is in fluid communication with the bore 24 in the sleeve 12. The adapter sleeve 28 is threadedly attached by threads 32 to the sleeve 12 and is arranged to provide an annular space 34 therebetween so that the passageways 24 and 30 will be in fluid communication regardless of the relative positions of the sleeves 12 and 28.

A lower end 36 on the stop member 20 is threadedly connected to an outer mandrel 38 which forms part of a packer assembly 40 that will be subsequently described. To prevent fluid in the passageway 30 from leaking into the bore 18 in the sleeve 12, a seal 42 is located in fluid-tight sealing engagement between the exterior of the outer mandrel 38 and the adapter sleeve 28. To prevent fluid communication between an annular passageway 44, which is in fluid communication with the passageway 30, and the well bore outside of the apparatus 10, a seal 46 is located in fluid-tight sealing engagement between the exterior of the outer mandrel 38 and the interior of a lower adapter sleeve 48.

The annular passageway 44 is located between the mandrel 38 and lower adapter sleeve 48 and is in fluid communication with an annular passageway 50 through ports 49. The passageway 50 is located between the outer mandrel 38 and an inner mandrel 52 both of which extend through the packer assembly 40.

Connected to the lower end of the lower adapter sleeve 48 is a connector sleeve 54 that is provided with a J-slot 56. The J-slot 56 can be more clearly seen in FIG. 3. As illustrated by dash lines in FIG. 1B, one leg 58 of the J-slot 56 extends through the bottom 60 of the connector sleeve 54. The J-slot 56 is sized and arranged to receive a gudgeon 62 that is located on the exterior of the outer mandrel 38.

Figure 1B:
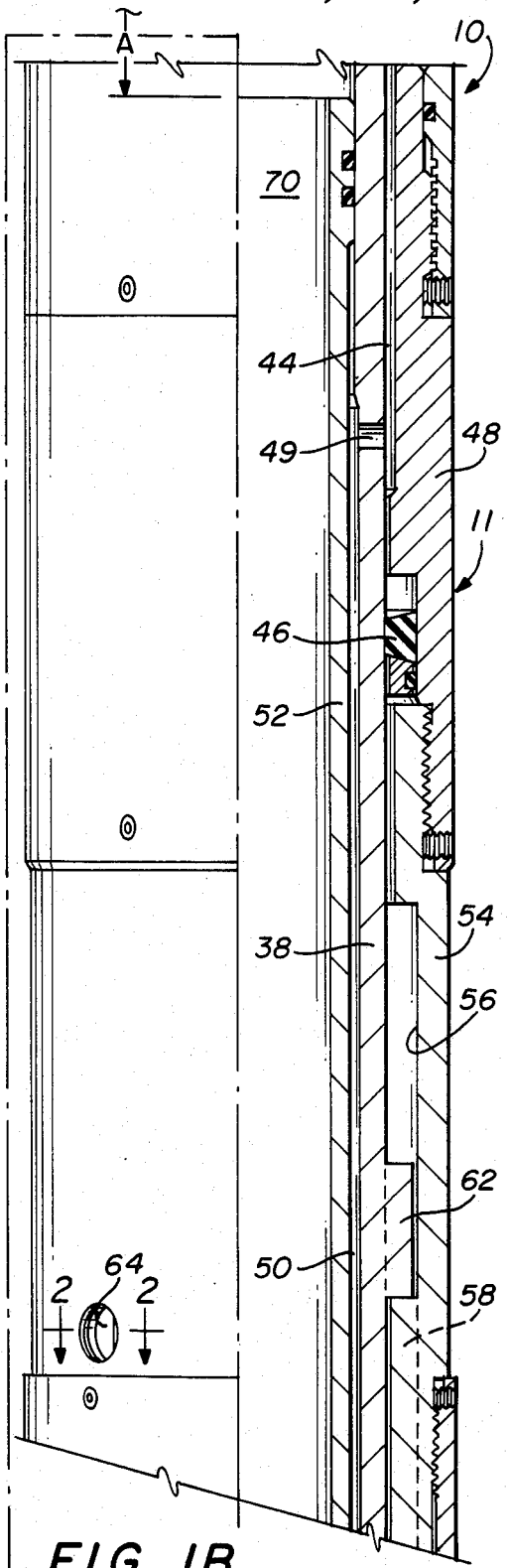
Figure 1C:
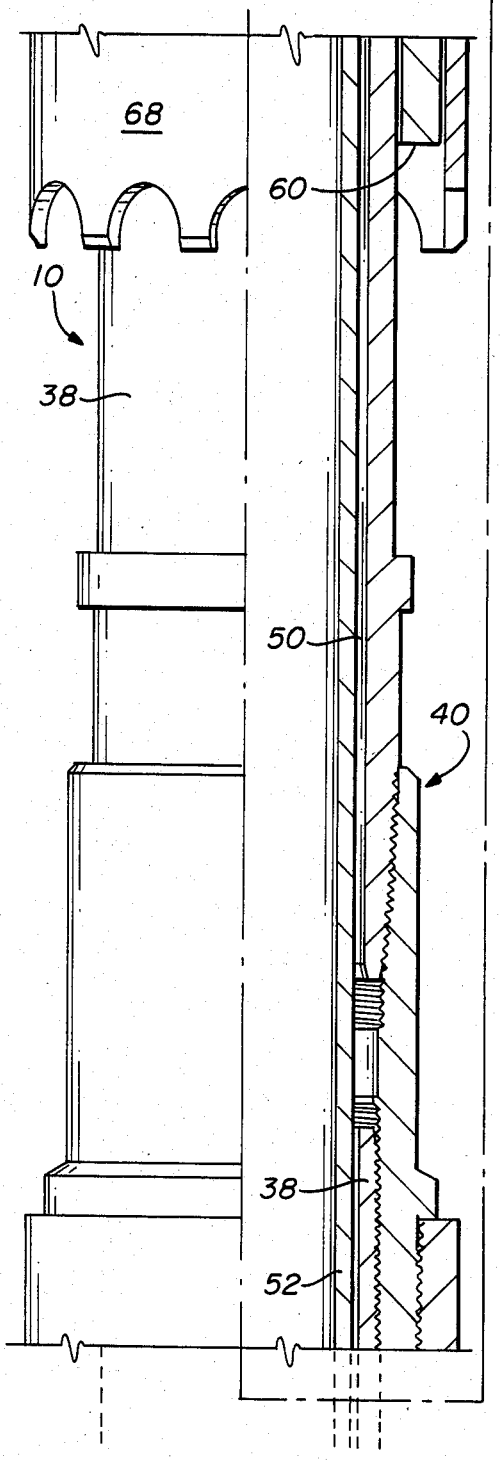
Figure 3:
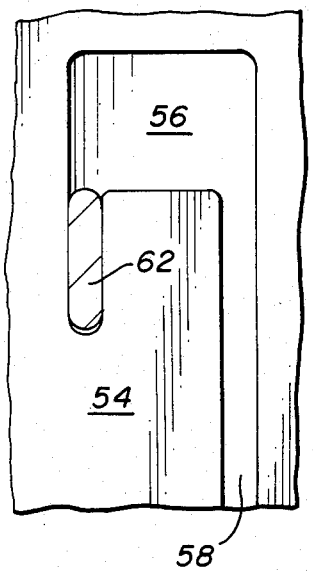
FIG. 3 is an enlarged, fragmentary view of a shear pin utilized in the treating apparatus.

When the apparatus 10 is run into the well bore, the gudgeon 62 and the J-slot 56 are located as illustrated in FIGS. 1B and 3. To assure that the parts remain in this position, one or more shear pins 64 are threaded into the connector sleeve 54 and into slots 66 (see FIG. 3) formed in the exterior of the outer mandrel 38. The shear pins 64 are designed so that they part upon the application of a predetermined tensile force. When they part, the gudgeon 62 and connector sleeve 54 can be moved relative to each other.

For assuring that connection between the connector sleeve 54 and the gudgeon 62 can be made in the well bore, an overshot mill 68 has been attached to the lower end of the connector sleeve 54. This mill 68 is used to align the sleeve 54 over the stop member 20 and to remove any debris as the sleeve 54 is moved downwardly towrd engagement with the gudgeon 62.

It will be noted in FIGS. 1A and 1B that the distance A between the lower end 36 of the stop member 20 and the upper end of the inner mandrel 52 has been selected to permit the proper relative movement between the gudgeon 62 and the connecting sleeve 54 in the J-slot 56.

The inner mandrel 52 includes a central bore 70 that is in communication with the bore 18 and extends through the packer assembly 40. Both the inner mandrel 52 and the outer mandrel 38, for the purposes of this description, project downwardly from the lower end of the packer assembly 40.

The packer assembly 40 (see FIGS. 1C and 1D) is shown only schematically. Any suitable packer assembly that will serve to isolate the zone to be treated and that can accommodate the inner and outer mandrels 52 and 38 respectively can be utilized.

Figure 1D:
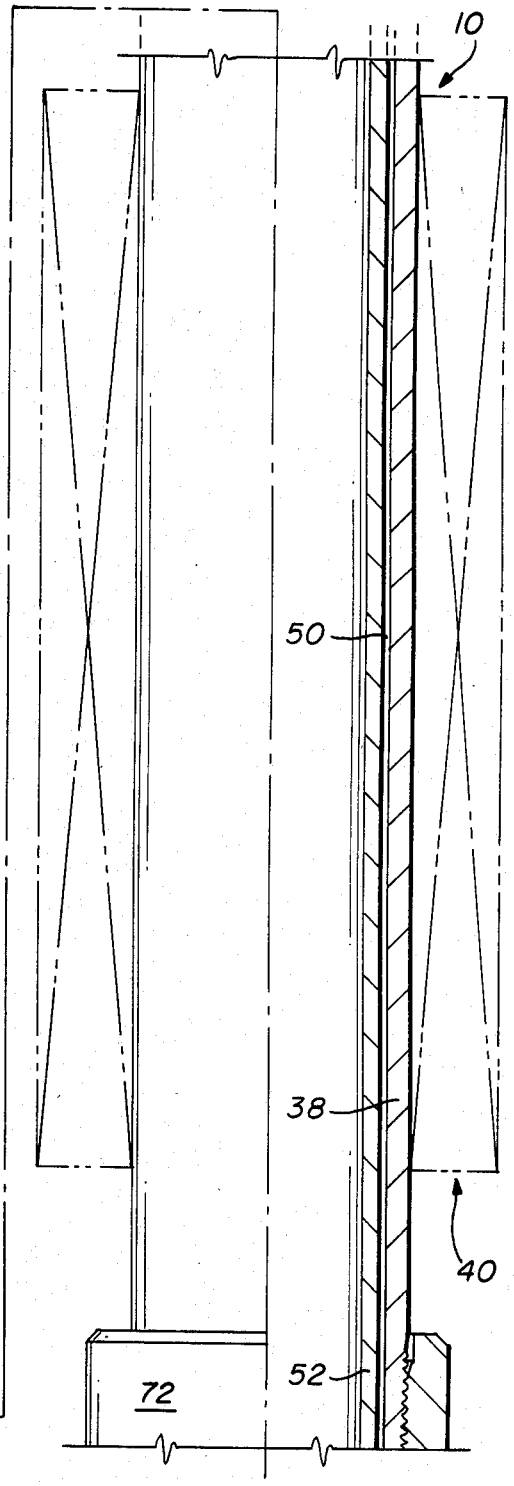
Figure 1E:
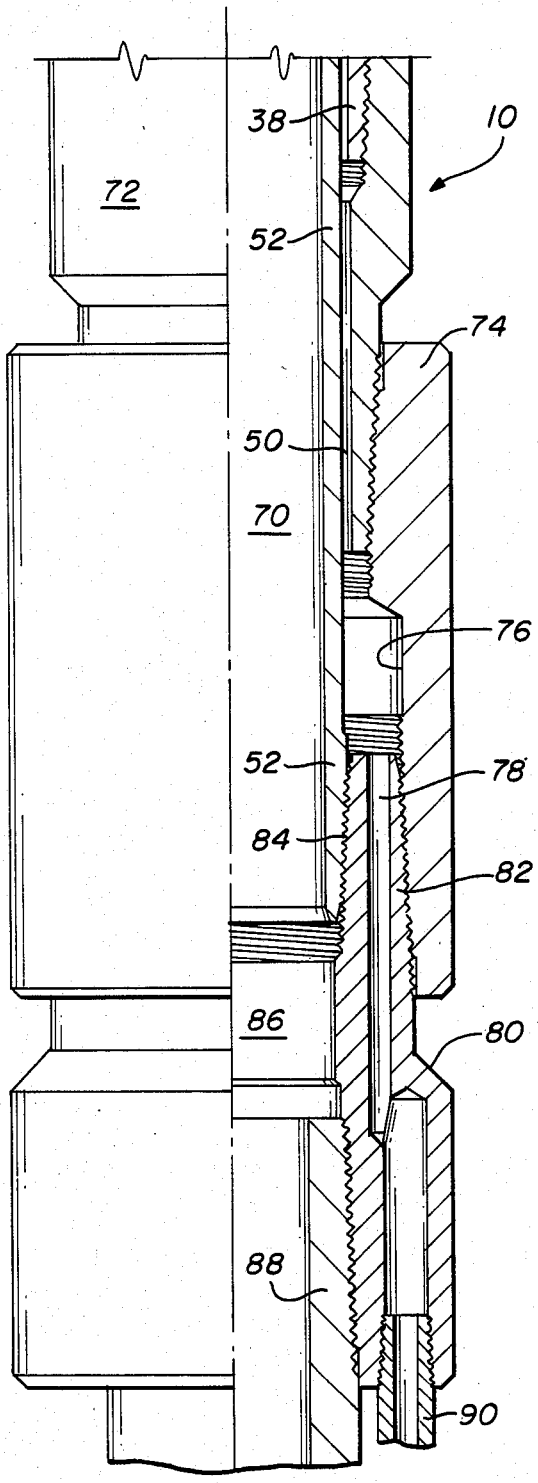
Figure 2:
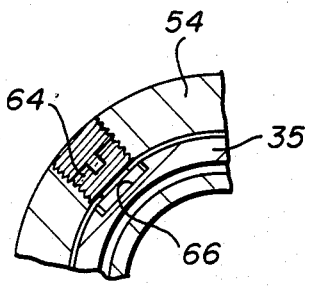
FIG. 2 is an enlarged, fragmentary layout of a J-slot and gudgeon arrangement that is utilized in the releasable connection.

Referring to FIGS. 1D and 1E, it can be seen that a connection sub 72 is threadedly connected to the lower end of the outer mandrel 38 and is connected at its lower end to a combination collar 74. The combination collar 74 includes a counterbore 76 which is sufficiently large to provide communication between the annular passageway 50 and a passageway 78 that is located in a bottom connector 80. The bottom connector 80 is threadedly connected to the combination collar 74 by threads 82 and threadedly connected in its interior to the lower end of the inner mandrel 52 by threads 84. Thus, the position of the inner mandrel 52 within the apparatus 10 is determined by the location of the bottom connector 80. It should also be pointed out that the bottom connector 80 includes a flow passageway 86 that is in communication with the central bore 70 through the inner mandrel 52.

The bottom connector 80 may also be threadedly connected to a lower tubing string 88 in its inner flow passageway 86 and may also be connected to a lower secondary tubing string 90 in the passageway 78.

OPERATION OF THE PREFERRED EMBODIMENT

When it is desired to treat a zone of the well bore, the apparatus 10 is connected to the tubing strings 14 and 16 and may, if desired, be connected to the lower tubing strings 88 and 90. As connected, the apparatus 10 is lowered in the well bore until the desired depth is reached. Upon reaching this position, the packer assembly 40 is actuated to isolate the zone to be treated.

The treating chemicals may then be injected through the interior of the tubing string 14, through the bore 18, through the interior 22 of the stop member 20, through the bore 70 in the inner mandrel 52, and outwardly through the bore 86 in the bottom connector 80. Thus, the treating chemicals are deposited in the well bore in the desired quantity and at the desired zone to be treated.

After the chemical treatment has taken place, the inhibitor, diluent or the like may be injected through the tubing string 16, the passageway 24 in the connection sleeve 12 and through the annular space 50 between the inner and outer mandrels 52 and 38. Ultimately the material flows outwardly through the passageway 78 in the bottom connector 80. Thus, the relatively small size of the tubing string 16 and of the various passageways connected therewith permit the use of small quantities of appropriate materials which can be quickly and efficiently injected into the treating chemicals in the isolated zone of the well bore that hs been treated.

Many variations in the operation can take place since the connecting sleeve 54 and all of the apparatus thereabove, excepting the stop member 20, and inner and outer mandrels 38 and 52 can be removed. Such components can be easily replaced if further chemical treatment of the isolated zone is desired or to remove the packer assembly 40.

From the foregoing, it can be appreciated that the apparatus described in detail provides the capability of quickly, easily and relatively economically treating an isolated zone in a well bore.

The detailed description of a single embodiment of the invention is presented by way of example only and many changes and modifications can be made thereto without departing from the spirit or scope of the invention.

What is claimed is:

1. Apparatus for delivering liquids, such as inhibitors, diluents and the like, to a selected zone of a well bore, the apparatus comprising:

conduit means extending from the surface into the well bore, said conduit means having first and second flow passageways extending therethrough;

packer means located in the well bore for isolating the selected zone and having a central flow passageway extending therethrough and an annular flow passageway arranged generally encircling said central flow passageway; and, connection means for releaseably connecting said packer means and conduit means whereby upon connection said first flow passageway and central flow passageway are connected and said second flow passageway and annular flow passageway are connected whereby treating fluids can be injected through the first and central flow passageways and inhibitors, diluents and the like can be delivered through the second and annular flow passageways to the selected zone.

2. The apparatus of claim 1 wherein said conduit means comprises:

a first conduit including said first flow passageway; and, a second conduit of substantially smaller size than said first conduit and including said second flow passageway.

3. The apparatus of claim 2 wherein:

said connection means comprises a tubular member having a first end arranged for connection to first and second conduits and a second end having a J-slot formed in the interior thereof; and, said packer means has a hollow outer mandrel and a hollow inner mandrel forming an annular flow passageway therethrough and a gudgeon on the exterior of said outer mandrel engageable with said tubular member in said J-slot for releaseably connecting said tubular member and packer means with said first flow passageway connected to said hollow inner mandrel and with said second flow passageway connected to said annular flow passageway.

4. The apparatus of claim 1 wherein:

said connection means comprises a tubular member having a first end arranged for connection to said conduit means and a second end having a J-slot in the interior thereof; and, said packer means has a hollow outer mandrel and a hollow inner mandrel forming an annular flow passageway therethrough and a gudgeon on the exterior of said outer mandrel engageable with said tubular member in said J-slot for releaseably connecting said tubular member and packer means with said first flow passageway connected to said hollow inner mandrel and with said second flow passageway connected to said annular flow passageway.

5. Improved connection means for use in apparatus for delivering liquids, such as inhibitors, diluents and the like, to a selected zone of a well bore wherein the apparatus includes conduit means extending from the surface into the well bore, the conduit means having first and second flow passageways extending therethrough and packer means located in the well bore for isolating the selected zone with the packer having a central flow passageway extending therethrough and an annular flow passageway generally encircling the central flow passageway, the improvement comprising:

connection means for releaseably connecting the packer means and conduit means, whereby upon connection the first flow passageway and central flow passageway are connected and the second flow passageway and annular flow passageway are connected whereby treating fluids can be injected through the first and central flow passageways and inhibitors, diluents and the like can be delivered through the second annular flow passageways to the selected zone.

6. The apparatus of claim 5 wherein said connection means comprises a tubular member having a first end arranged for connection to said conduit means and a second end having a J-slot in the interior thereof, said J-slot being sized to receive a gudgeon that is located on a hollow outer mandrel in the packer means, releaseably connecting said tubular member and packer means with the first flow passageway connected to a hollow inner mandrel in the packer means and with the second flow passageway connected to the annular flow passageway in the packer means.

* * * * *